US005498505A

United States Patent [19]

Tsukahara et al.

[11] Patent Number: 5,498,505

[45] Date of Patent: Mar. 12, 1996

[54] DYE FIXING ELEMENT

[75] Inventors: Jiro Tsukahara; Hiroshi Arakatsu, both of Kanagawa, Japan

[73] Assignee: Fuji Photo Film Co., Ltd., Kanagawa, Japan

[21] Appl. No.: 361,154

[22] Filed: Dec. 21, 1994

Related U.S. Application Data

[63] Continuation of Ser. No. 913,058, Jul. 14, 1992, abandoned.

[30] Foreign Application Priority Data

Jul. 15, 1991 [JP] Japan ..... 3-198279

[51] Int. Cl.[6] ..... G03C 8/00; G03C 1/06; G03C 1/815/825

[52] U.S. Cl. ..... 430/213; 430/518; 430/941; 526/258; 526/262; 526/310

[58] Field of Search ..... 430/213, 518, 430/941; 526/258, 262, 310

[56] References Cited

U.S. PATENT DOCUMENTS

| | | | |
|---|---|---|---|
| 3,788,855 | 1/1974 | Cohen et al. | 430/518 |
| 4,147,548 | 4/1979 | Kanino et al. | 430/213 |
| 4,463,080 | 7/1984 | Snow et al. | 430/213 |
| 4,544,621 | 10/1985 | Roth | 526/258 |
| 5,023,162 | 6/1991 | Yamanouchi et al. | 430/203 |
| 5,230,993 | 7/1993 | Yamada et al. | 430/518 |
| 5,250,409 | 10/1993 | Yasunami et al. | 430/518 |
| 5,308,747 | 5/1994 | Szajewski et al. | 430/518 |
| 5,322,758 | 6/1994 | Texter et al. | 430/213 |

*Primary Examiner*—Charles L. Bowers, Jr.
*Assistant Examiner*—J. Pasterczyk
*Attorney, Agent, or Firm*—Sughrue, Mion, Zinn, Macpeak & Seas

[57] ABSTRACT

A dye fixing element comprising a polymer mordant, said polymer mordant containing at least one monomeric unit including at least one group derived from the class of tertiary amines, thioethers, aromatic 5-membered heterocyclic rings, hydrazides, hydrazones and polyarylphenols, and at least one quaternary ammonium group.

12 Claims, No Drawings

DYE FIXING ELEMENT

This is a Continuation of application Ser. No. 07/913,058 filed Jul. 14, 1992 now abandoned.

FIELD OF THE INVENTION

The present invention relates to a novel cationic polymer capable of functioning as a mordant for imagewise produced diffusible anionic dyes, and to a dye fixing element which comprises a layer containing the novel mordant. The dye fixing element is particularly useful in a diffusion transfer process.

BACKGROUND OF THE INVENTION

In a diffusion transfer process (or a photographic art of forming an image by fixing an imagewise produced diffusible dye on a dye fixing element), a cationic polymer mordant is often used for fixing a diffusible anionic dye on a dye fixing element. In ink jet and thermal dye-transfer methods as well, it has been proposed to use a cationic polymer mordant for fixation of anionic dyes on a dye fixing element.

Polymer mordants as described above are disclosed, for example, in U.S. Pat. Nos. 3,898,088, 3,958,995 and 4,131,469, German Patent (OLS) No. 2,941,818, JP-A-53-30328 and JP-A-56-17352 (the term "JP-A" as used herein means an "unexamined published Japanese patent application").

The most important property among those required of such mordants is to impart excellent preservability to images. Although images obtained in accordance with a diffusion transfer process may deteriorate by various mechanisms, two mechanisms in particular pose serious problems from a practical viewpoint. More specifically, one deterioration mechanism relates to movement of dyes inside the dye fixing element or transferring of dyes onto other substances, and the other relates to discoloration of dyes upon exposure to light.

Accordingly, excellent mordants are those having not only high ability to retain and to fix dyes thereon (high mordanting power) but also function to-inhibit the dyes fixed thereon from suffering photo-discoloration.

In this regard, there has been a fair amount of research seeking mordants having the above properties. For example, mention may be made of those disclosed in British Patents 2,011,912, 2,056,101 and 2,093,041, U.S. Pat. Nos. 4,115,124, 4,273,853 and 4,282,305, JP-A-59-232340, JP-A-60-118834, JP-A-60-128443, JP-A-60-122940, JP-A-60-122921, JP-A-60-235134 and so on.

Each of the above-mentioned mordants was somewhat, but not wholly satisfactory. Accordingly, it is still desired to make mordants more satisfactory in the above respects.

SUMMARY OF THE INVENTION

An object of the present invention is to provide a dye fixing element which is excellent in mordanting power and which prevents mordanted dyes from discoloring upon exposure to light, resulting in formation of color images having improved preservability.

As a result of our intensive studies, it has been found that the above and other objects and advantages of the present invention can be achieved by means of a dye fixing element comprising a polymer mordant, said polymer mordant containing at least one monomeric unit including at least one group derived from class of tertiary amines, thioethers, aromatic 5-membered heterocyclic rings, hydrazides, hydrazones and polyarylphenols, and at least one quaternary ammonium group.

DETAILED DESCRIPTION OF THE INVENTION

Suitable monomeric units, which make up at least a portion of the polymer mordant in accordance with the present invention, are described below in detail. As discussed thereafter, the polymer mordant may be a homopolymer made up entirely of these monomeric units, or such units may be copolymerized with other suitable monomers.

Suitable tertiary amines in the monomeric units of the present invention include trialkylamines, dialkylanilines, diarylalkylamines, triarylamines and cyclic tertiary amines. These amines may have one or more substituent groups, if desired.

Suitable thioethers include dialkyl sulfides, diaryl sulfides and alkylaryl sulfides. These sulfides may also have one or more substituent groups, if desired.

Suitable aromatic 5-membered heterocyclic rings include monocyclic ring groups, such as furan, thiophene, pyrrole, pyrazole, imidazole, oxazole, thiazole, isooxazole, triazole and the like, and condensed rings formed by fusing together one or more of a benzene ring and one of the above-cited rings, such as benzofuran, isobenzofuran, benzothiophene, indole, indazole, benzimidazole, carbazole, dibenzofuran and so on. These rings may have one or more substituent groups, as desired.

Suitable hydrazides include acylhydrazines wherein the nitrogen atom which is not attached directly to the carbonyl group has two alkyl substituents, or two aryl substituents, or one alkyl substituent and one aryl substituent. These acylhydrazines may also be further substituted.

Suitable hydrazones include hydrazones having two alkyl substituents, or two aryl substituents, or one alkyl substituent and one aryl substituent. These compounds may also be further substituted.

Suitable polyarylphenols include diarylphenols, triarylphenols and ether derivatives thereof. These phenols may have one or more substituent groups.

Examples of substituent groups suitable for the above-discussed groups contained in the monomeric units of the present invention, include a halogen atom (e.g., chlorine, bromine), a hydroxyl group, an alkoxy group (e.g., methoxy, ethoxy, methoxyethoxy, benzyloxy), an aryloxy group (e.g., phenoxy), an alkyl group (e.g., methyl, ethyl, decyl), an aryl group (e.g., phenyl, naphthyl), an aralkyl group (e.g., benzyl, phenethyl), a nitro group, a cyano group, an acylamino group (e.g., acetylamino, benzoylamino, phenoxyacetylamino), a sulfonamido group (e.g., methanesulfonamido, p-toluenesulfonamido), a ureido group, an alkoxycarbonyl group (e.g., methoxycarbonyl, benzyloxycarbonyl), a carbamoyl group (e.g., carbamoyl, N-methylcarbamoyl, N,N-diphenylcarbamoyl), a sulfamoyl group (e.g., sulfamoyl, N-methylsulfamoyl, N,N-diphenylsulfamoyl), an acyl group (e.g., acetyl, benzoyl), an acyloxy group (e.g., acetoxy, benzoyloxy), a sulfonyl group (e.g., methanesulfonyl, benzenesulfonyl), and so on.

The "at least one group derived from the class of tertiary amines, thioethers, aromatic 5-membered heterocyclic rings, hydrazides, hydrazones and polyarylphenols", which is an essential aspect of the monomeric units of the present invention, is abbreviated as "ALFA group" hereinafter. The ALFA group signifies a monovalent or polyvalent group obtained by removing at least one hydrogen atom from a compound selected from among the above-cited tertiary amines, thioethers, aromatic 5-membered heterocyclic rings, hydrazides, hydrazones and polyarylphenols.

In the class of ALFA group members as defined above, groups derived from tertiary amines or aromatic 5-membered heterocyclic rings are preferred over the others.

Specific examples of ALFA groups, at least one of which is present in the monomeric units of the present invention, are illustrated below, but the invention should not be construed as being limited to the following groups.

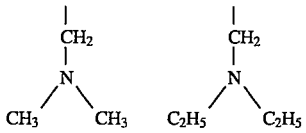
(1)

(2)

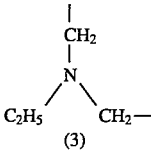
(3)

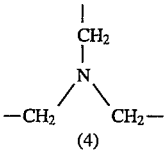
(4)

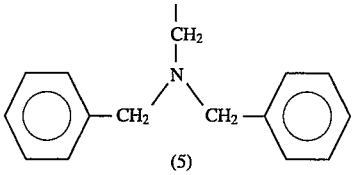
(5)

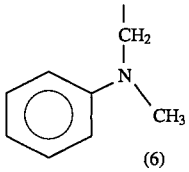
(6)

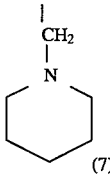
(7)

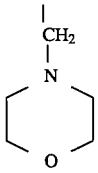
(8)

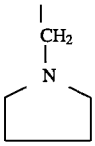
(9)

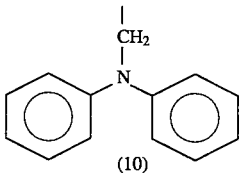
(10)

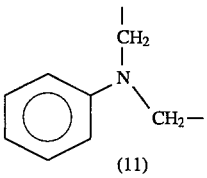
(11)

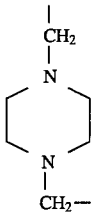
(12)

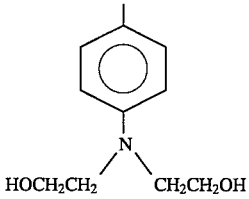
(13)

-continued

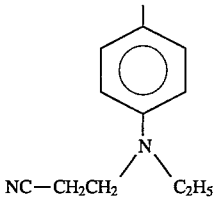
(14)

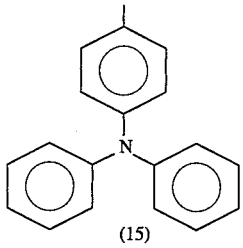
(15)

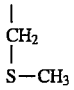
(16)

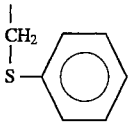
(17)

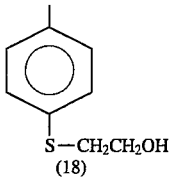
(18)

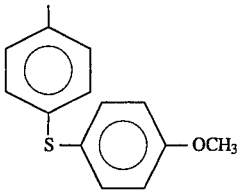
(19)

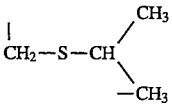
(20)

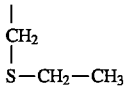
(21)

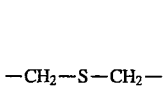
(22)

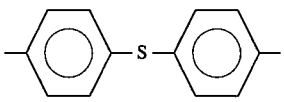
(23)

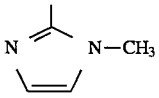
(24)

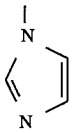
(25)

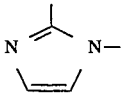
(26)

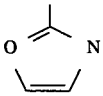
(27)

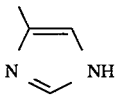
(28)

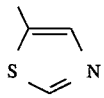
(29)

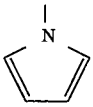
(30)

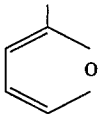
(31)

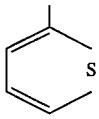
(32)

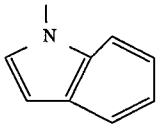
(33)

-continued

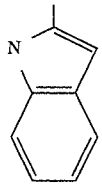

(34)

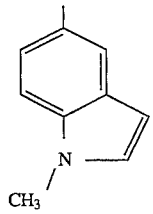

(35)

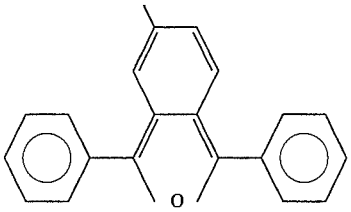

(36)

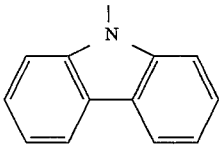

(37)

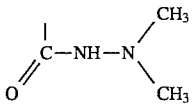

(38)

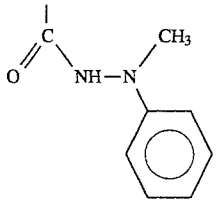

(39)

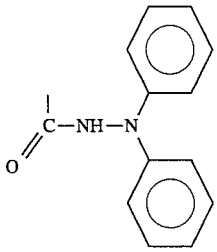

(40)

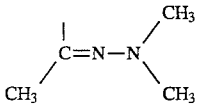

(41)

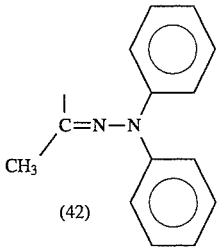

(42)

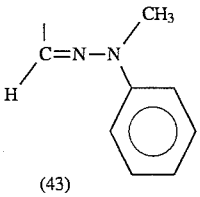

(43)

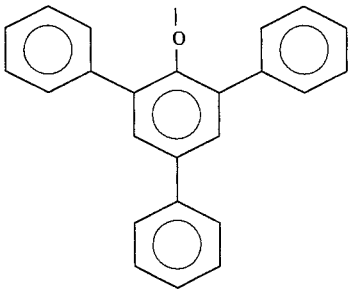

(44)

-continued

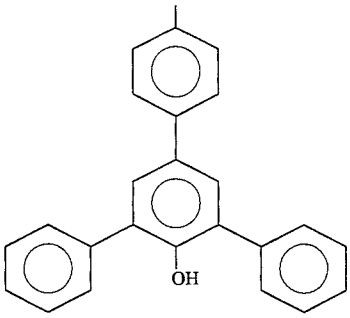

(45)

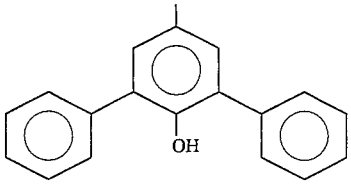

(46)

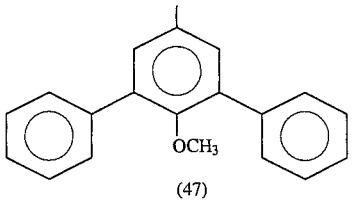

(47)

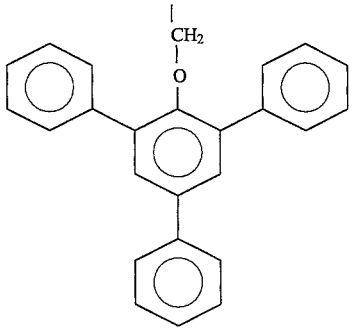

(48)

At least one quaternary ammonium group in the monomeric units of the present invention is essential to a polymer mordant according to the present invention, which has as a primary objective fixing of anionic dyes in a dye fixing element. The term "quaternary ammonium group" as used herein means a monovalent or polyvalent organic group containing at least one nitrogen atom which bears a positive formal charge and is not bonded directly to any hydrogen atom.

Such quaternary ammonium groups are always accompanied by a counter anion. Suitable examples of such a counter anion include halide ions (e.g., chloride ion, bromide ion), sulfonic acid ions (e.g., methanesulfonic acid ion, p-toluenesulfonic acid ion), carboxylic acid ions (e.g., acetic acid ion, propionic acid ion), monoalkyl sulfate ions (e.g., monomethyl sulfate ion, monoethyl sulfate ion), $PF_6^-$, $BF_4^-$, and so on. Of these ions, chloride ion, sulfonic acid ions and carboxylic acid ions are desirable in particular.

Specific examples of quaternary ammonium groups which are preferably used in the monomeric units of the present invention are illustrated below. However, the invention should not be construed as being limited to the following examples.

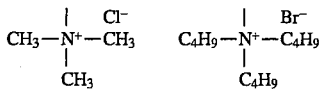

(1)

(2)

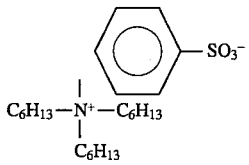

(3)

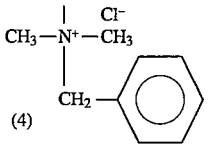

(4)

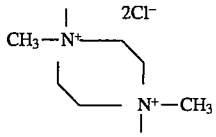

(5)

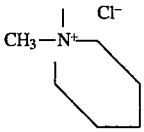

(6)

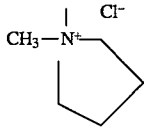

(7)

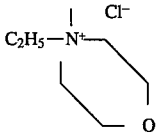

(8)

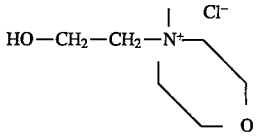

(9)

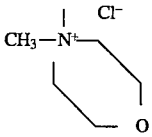

(10)

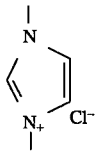

(11)

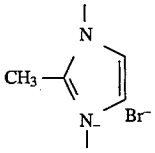

(12)

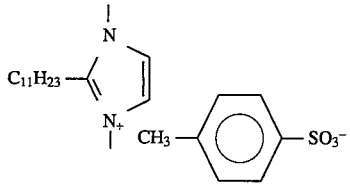

(13)

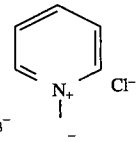

(14)

-continued

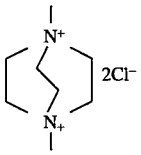

(15)

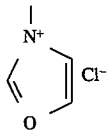

(16)

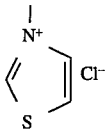

(17)

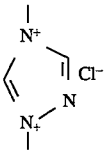

(18)

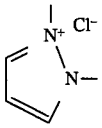

(19)

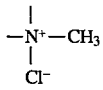

(20)

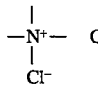

(21)

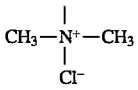

(22)

The monomeric units of the present invention include at least one quaternary ammonium group and at least one ALFA group bonded to each other directly or indirectly via a linkage group. The number of quaternary ammonium groups in one monomeric unit as defined herein may be 1, 2 or 3, and is preferably 1.

The number of ALFA groups in one monomeric unit is preferably 1, though it also may be 1, 2 or 3.

The monomeric units of the present invention include those capable of undergoing polycondensation or polyaddition (e.g., the monomer units contain as a partial structure a dibasic acid moiety, a diamine moiety, a diol moiety, a diisocyanate moiety, and so on), or they may be ethylenic monomer units capable of undergoing radical polymerization. Of these types, ethylenic monomer units are of greater advantage.

More specifically, units of an ethylenic monomer containing one quaternary ammonium group and one ALFA group are preferred embodiments of the monomeric units of the present invention. The most desirable among such units are represented by the following formula (I):

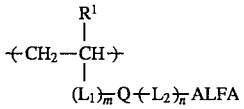

(I)

wherein $R^1$ represents a hydrogen atom or an alkyl group containing 1 to 6 carbon atoms (e.g., methyl, ethyl, butyl); $L_1$ and $L_2$, which may be the same or different, each represents a divalent linkage group; m and n each represents 0 or 1; Q represents a quaternary ammonium group as illustrated above; and ALFA represents an ALFA group as illustrated above.

$L_1$ and $L_2$ in the foregoing formula (I) are described below in more detail.

Divalent linkage groups preferred as $L_1$ and $L_2$ include an ether linkage, a carbonyl group, an alkylene group (e.g., methylene, ethylene, butylene), an arylene group (e.g., phenylene), an alkyleneoxy group (e.g., methyleneoxy, ethyleneoxy), an aryleneoxy group (e.g., phenyleneoxy) and a divalent group formed by linking together two or more of the above-cited linkage groups in series.

Specific examples of divalent linkage groups preferred as $L_1$ and $L_2$ are illustrated below. However, the invention should not be construed as being limited to these examples.

$-CH_2-CH_2-$ (1)

$-CH_2-CH_2-CH_2-$ (2)

$-CH_2-CH_2-CH_2-CH_2-$ (3)

$-CH_2-CH_2-O-CH_2-CH_2-$ (4)

$-CH_2-CH(OH)-CH_2-$ (5)

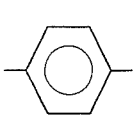
(6)

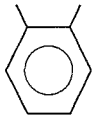
(7)

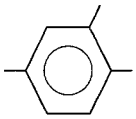
(8)

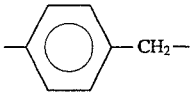
$-CH_2-$ (9)

$-CH_2-CH_2-C(=O)-CH_2CH_2-$ (10)

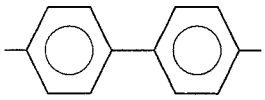
(11)

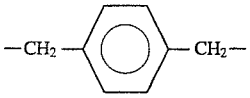
$-CH_2-$ (12)

$-CH_2-CH(CH_3)-$ (13)

$-CH_2-CH_2-O-CH_2CH_2-O-CH_2CH_2-$ (14)

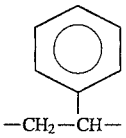
$-CH_2-CH(Cl)-CH_2-$ (15)

$-CH_2-CH-$ (16)

$-CH_2-CH_2C(=O)-O-CH_2-CH_2-$ (17)

Specific examples of monomeric units most preferred among those represented by the foregoing formula (I), which are included among the more broadly defined monomeric units of the present invention, are illustrated below. However, the invention should not be construed as being limited to the following examples.

(1)

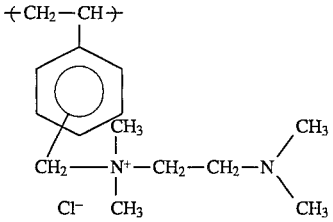

(2)

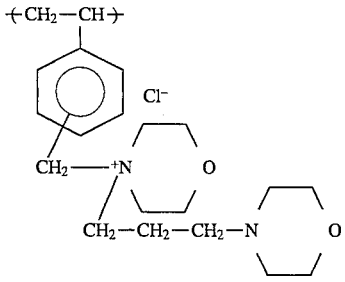

(3)

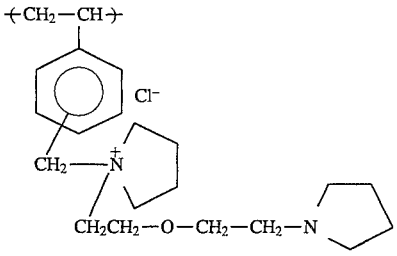

(4)

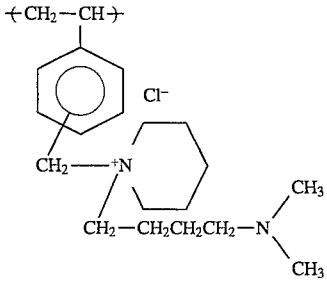

(5)

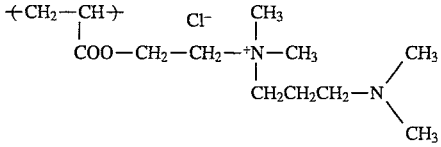

(6)

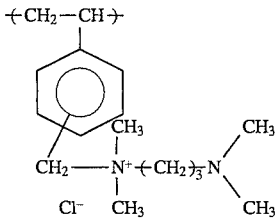

(7)

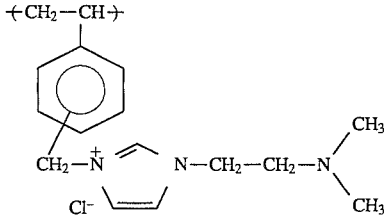

-continued
(8)
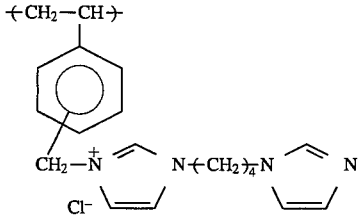
(9)
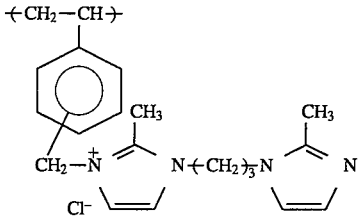
(10)
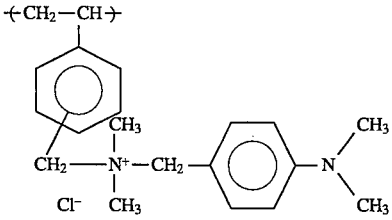
(11)
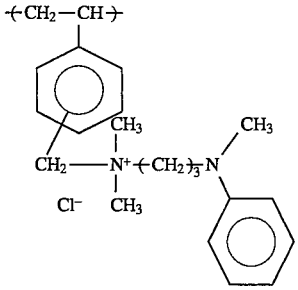
(12)
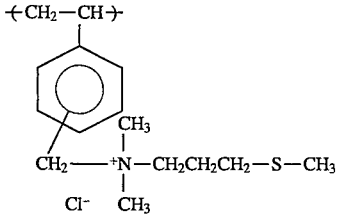
(13)
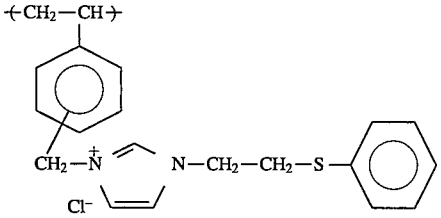
(14)
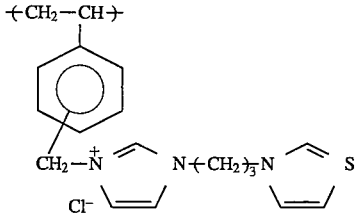
-continued
(15)
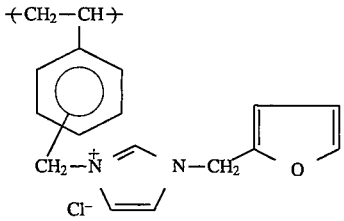
(16)
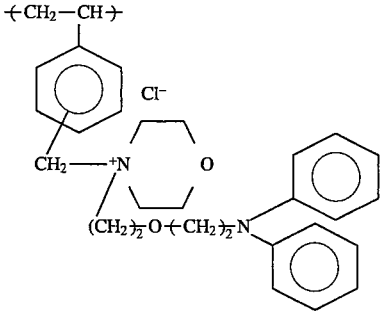
(17)
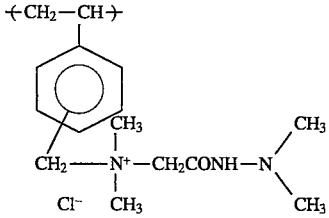
(18)
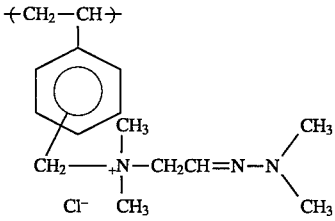
(19)
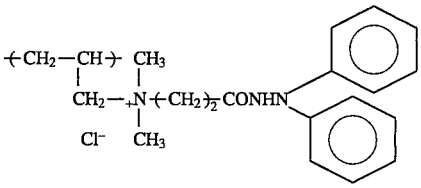
(20)
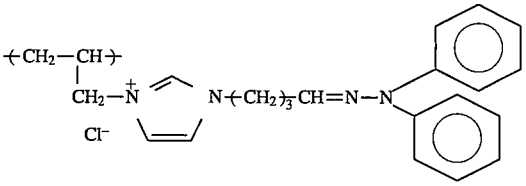

-continued (21)

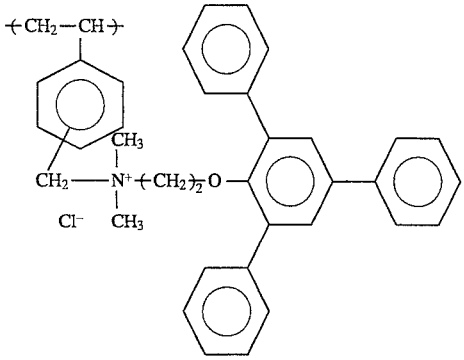

(22)

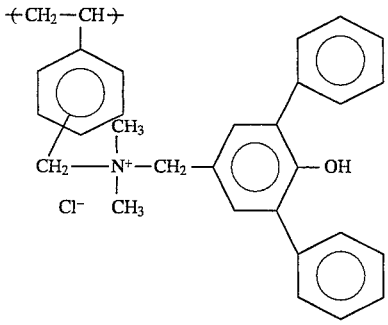

Preferred polymer mordants employed in the practice of the present invention are described below in greater detail.

The polymer mordants of the present invention may be homo- or copolymers comprising one or more monomer units according to the present invention, or copolymers comprising one or more monomer units according to the present invention and one or more monomer units other than those according to the present invention.

The percentage of the monomeric units according to the present invention based on the total amount of monomeric units constituting the polymer mordant of the present invention is of significance in the improvement of mordanting power and light fastness of dyes. In general, the inventive monomers should comprise at least 10% (by weight), more preferably at least 50% (by weight).

As described above, monomeric units other than those of the present invention can be used as copolymerizing constituents in the polymer mordant of the present invention. In general, such other constituents are monomeric units derived from ethylenically unsaturated monomers.

Examples of ethylenically unsaturated monomers which are preferably used in a copolymer mordant of the present invention include propylene, 1-butene, isobutene, styrene, α-methylstyrene, N-vinylimidazole, vinyl acetate, vinylpyridines, acrylic acid, acrylates, methacrylic acid, methacrylates, acrylamide, methacrylamide, N-alkylacrylamides, acrylonitrile, methacrylonitrile, N-vinylpyrrolidone, butadiene, isoprene, styrenesulfinates, hydroxymethylstyrene, chloromethylstyrene, and styrene derivatives containing various cationic groups prepared from chloromethylstyrene and tertiary amines or nitrogen-containing heterocyclic compounds.

In addition, bifunctional monomers such as divinylbenzene, ethylene glycol dimethacrylate, isopropylene glycol diacrylate, tetramethylene glycol dimethacrylate, tetramethylene glycol diacrylate, and the like can be used advantageously as copolymeric constituents. These bifunctional monomers can be preferably used when an emulsion polymerization method is employed in preparing the polymer mordant.

In incorporating the mordant of the present invention into the dye fixing element, it is desirable that the mordant be designed so as to hardly move from a mordanting layer into other layers present in the dye fixing element. For instance, water-insoluble mordants, aqueous sol mordants or latex dispersion mordants are employed to advantageously for this purpose.

In particular, latex dispersion mordants are preferred over others, and a desirable particle size of the dispersion therein ranges from 0.01 to 2.0 μm, preferably from 0.05 to 0.2 μm.

A coverage of the inventive mordant, although it may vary depending on the kind of the mordant, the content of quaternary cationic groups, the kind and the amount of the dyes to be mordanted, the kind of the binder used together therewith, and so on, is generally in the range of from about 0.1 to about 20 g/m$^2$, preferably in the range of 0.5 to 5.0 g/m$^2$, and particularly preferably in the range of 1 to 3 g/m$^2$.

The latex polymer mordants which can be suitably used in the present invention can be produced by subjecting monomers according to the present invention and bifunctional monomers as described above to an emulsion polymerization reaction.

In general, emulsion polymerization can be effected in the presence of at least one surfactant selected from among anionic surfactants (e.g., the surfactant Triton™ produced by Rohm & Haas Co.), cationic surfactants (e.g., cetyltrimethylammonium chloride) or nonionic surfactants (e.g., polyvinyl alcohol), as well as a radical initiator (e.g., combination of potassium persulfate and sodium hydrogensulfite).

Specific examples of polymer mordants according to the present invention are illustrated below. However, the invention should not be construed as being limited to the following examples.

Compound 1:

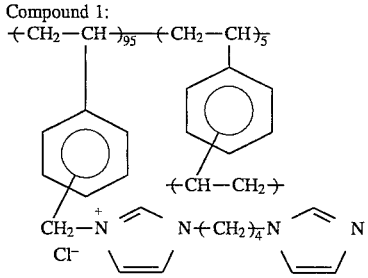

Compound 2:

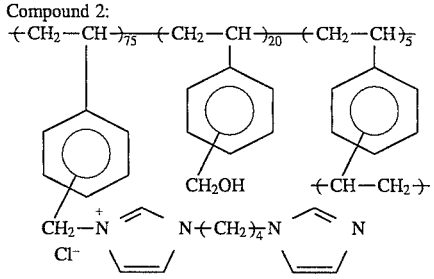

-continued
Compound 3:
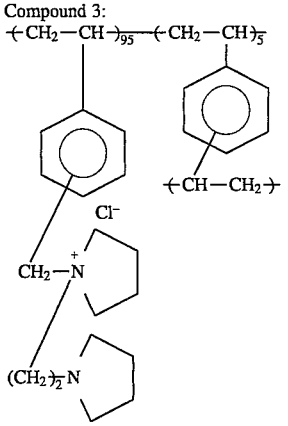
Compound 4:
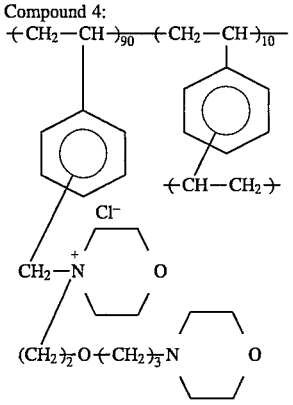
Compound 5:
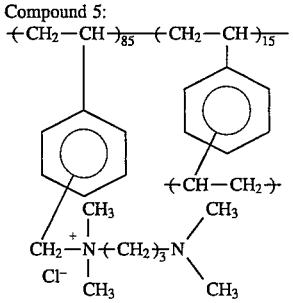
Compound 6:
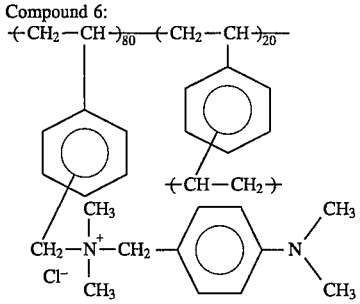
Compound 7:
-continued
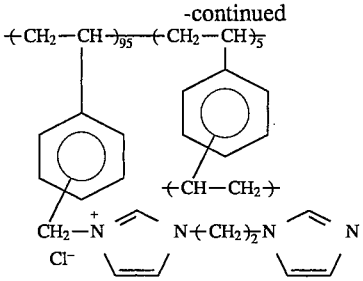
Compound 8:
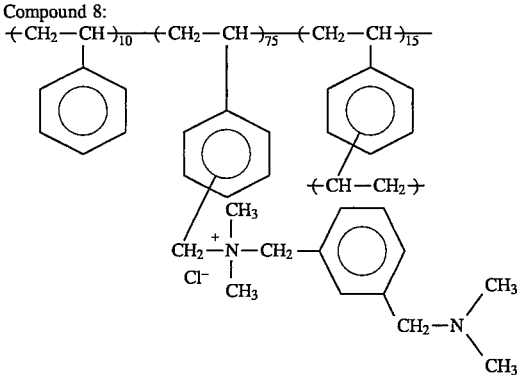
Compound 9:
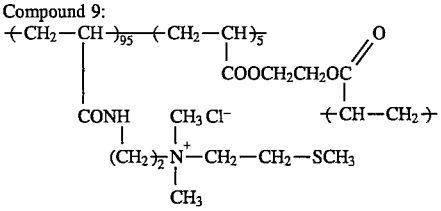
Compound 10:
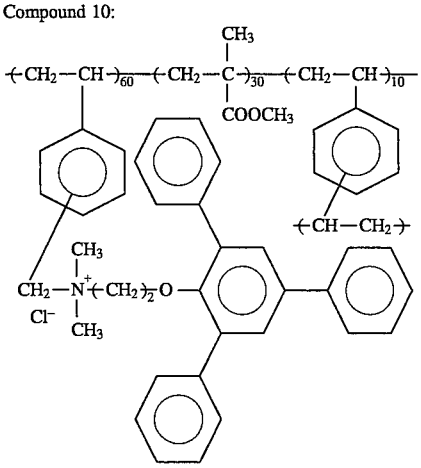
Compound 11:
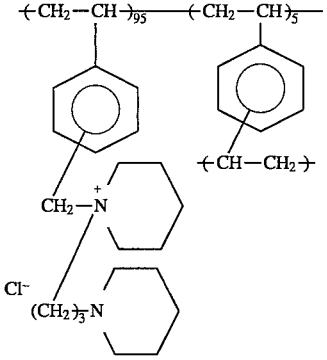

-continued

Compound 12:

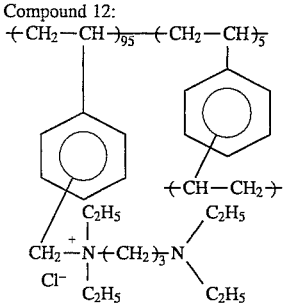

Compound 13:

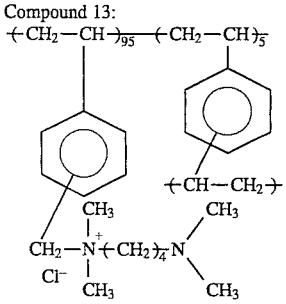

Compound 14:

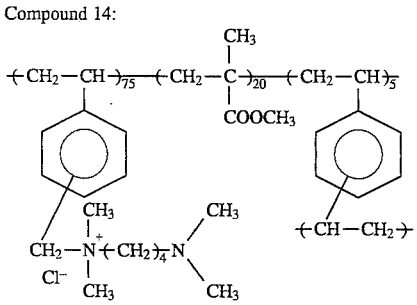

Compound 15:

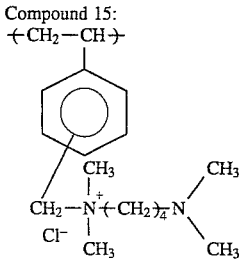

Compound 16:

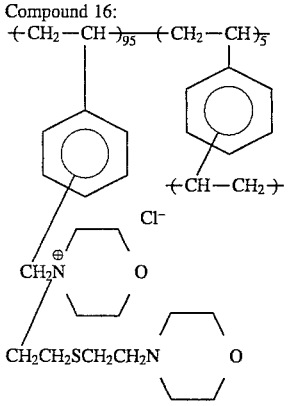

A specific synthesis example of a specific polymer mordant according to the present invention is described below. However, the invention should not be construed as being limited to the following example.

Synthesis Example

1. Synthesis of Monomer:

144.2 g (1.0 mole) of N,N,N',N'-tetramethyl-1,4-butanediamine and 0.1 g of p-methoxyphenol were dissolved in 400 ml of acetonitrile, and heated under reflux. Thereto, 76.3 g (0.50 mole) of chloromethylstyrene (meta-para 40:60 mixture) was added dropwise over a 1-hour period. After removal of acetonitrile by distillation under reduced pressure, the reaction product was poured into 2 l of ethyl acetate. The resulting solid was sucked off, and washed with two 500 ml portions of ethyl acetate. Thus, 103 g of N,N-dimethyl-N-(4-dimethylaminobutyl)-N-vinylbenzylammonium chloride was obtained (in a 69% yield).

2. Synthesis of Exemplified Compound 13:

150 ml of distilled water was placed in a reaction vessel, and degassed with nitrogen. Thereto, 3 ml of Triton 770, 28.2 g (0.095 mole) of N,N-dimethyl-N-(4-dimethylaminobutyl)-N-vinylbenzylammonium chloride synthesized in the above-described manner and 0.65 g (0.005 mole) of divinylbenzene were added and heated up to 60° C. with stirring. To the resulting mixture, 0.1 g of sodium sulfite dissolved in 5 ml of distilled water degassed with nitrogen and 0.3 g of potassium persulfate dissolved in 10 ml of distilled water degassed with nitrogen were added simultaneously, and stirred for 5 hours as the heating was continued. Then, the reaction mixture was cooled to room temperature, and filtered. Thus, 180 g of polymer dispersion (latex) was obtained. (Solid concentration: 15%)

A dye fixing element which contains at least one polymer mordant of the present invention is described below in detail.

The dye fixing element of the present invention contains at least one layer comprising at least one polymer mordant of the present invention as described above, and is used as an image receiving layer or an image receiving element in a method of forming an image through transfer of dyes (representative methods being instant photography, an ink jet method, a thermal dye transfer process and so on).

In the dye fixing element of the present invention, a layer may be formed using a polymer mordant of the present invention alone or in combination with other natural or synthetic hydrophilic polymers generally used in the photographic arts, such as gelatin, polyvinyl alcohol, polyvinylpyrrolidone, etc. In this regard, polyvinyl alcohol is especially preferred.

The dye fixing element of the present invention maybe comprised of two or more of the mordants of the present invention, and may further contain other mordants. As examples of mordants which can be contained together with the mordants of the present invention in the dye fixing element of the present invention, those disclosed in U.S. Pat. Nos. 4,131,469 and 4,147,548, JP-A-52-136626, JP-A-54-126027 and JP-A-54-145529 may be used.

An amount of the polymer mordant to be used can be easily determined by those of ordinary skill in the art depending on the amount of dyes to be mordanted, the kind and the composition of the polymer mordants, the image forming process adopted, and so on. As a general guideline, however, the polymer mordant is preferably used in the mordanting layer in a proportion of about 20 to about 80 wt %, more preferably 40 to 60 wt %, based on the total weight of the mordanting layer components. Alternatively, a preferred amount coverage is about 5 to 15 g/m$^2$, more preferably 1 to 10 g/m$^2$.

Known discoloration inhibitors may be used in the present invention. They include, e.g., antioxidants, ultraviolet absorbents, and certain metal complexes. These discoloration inhibitors may be used in the layer containing a polymer mordant of the present invention or a layer adjacent thereto in a condition that they remain therein after the processing for image formation is finished.

Suitable examples of antioxidants which can be used include chroman compounds, coumaran compounds, phenol compounds (e.g., hindered phenols), hydroquinone derivatives, hindered amine derivatives and spiroindane compounds. In addition, the compounds disclosed in JP-A-61-159644 are effective, too.

Suitable examples of ultraviolet absorbents which can be used include benzotriazole compounds (e.g., those disclosed in U.S. Pat. Nos. 3,533,794), 4-thiazolidone compounds (e.g., those disclosed in U.S. Pat. No. 3,352,681), benzophenone compounds (e.g., those disclosed in JP-A-46-2784), and the compounds disclosed in JP-A-54-48535, JP-A-62-136641 and JP-A-61-88256. In addition, the ultraviolet absorbing polymers disclosed in JP-A-62-260152 may be advantageously employed.

Suitable examples of metal complexes which can be used include the compounds disclosed in U.S. Pat. Nos. 4,241,155, 4,245,018 (from 3rd to 36th columns), 4,254,195 (from 3rd to 8th columns), JP-A-62-174741, JP-A-61-88356 (from p. 27 to p. 29), JP-A-1-75568, and JP-A-63-199248.

Other useful discoloration inhibitors are disclosed, e.g., in JP-A-62-215272, from (125) to (147).

A discoloration inhibitor for preventing dyes transferred into an image receiving element from discoloring may be incorporated in advance in a dye fixing element, or may be provided to a dye fixing element from an external source, e.g., as in the case of a light-sensitive element.

The above-cited antioxidants, ultraviolet absorbents and metal complexes may be used in combination of two or more thereof, as necessary or desired.

A color diffusion transfer process, which is a particularly useful application of the present invention, is described below.

A typical format of a film unit used in a color diffusion transfer process includes integrating a transparent support, a dye fixing element and a light-sensitive element into a unit; this requires no separate step for separating the light-sensitive element from the dye fixing element after the completion of a transferred image. More specifically, the dye fixing element comprises at least the above-described mordanting layer, while in a preferred embodiment the light-sensitive element comprises the combination of a blue-sensitive emulsion layer, a green-sensitive emulsion layer and a red-sensitive emulsion layer, the combination of a green-sensitive emulsion layer, a red-sensitive emulsion layer and an infrared-sensitive emulsion layer or the combination of a blue-sensitive emulsion layer, a red-sensitive emulsion and an infrared-sensitive emulsion layer, wherein the emulsion layers in each combination are associated with a yellow dye-providing material, a magenta dye-providing material and a cyan dye-providing material, respectively, in the order of description. (Herein, the term "infrared-sensitive emulsion layer" refers to an emulsion layer having sensitivity to light of wavelengths longer than 700 nm, especially longer than 740 nm). Further, a white reflective layer containing a solid pigment such as titanium dioxide is provided between the mordanting layer and the light-sensitive layer or the dye-providing material-containing layer so that the transferred image can be viewed through the transparent support.

For the purpose of effecting development processing in daylight, a light-intercepting layer may be provided between the white reflective layer and the light-sensitive layer. Furthermore, a release layer may be provided in an appropriate position so that the whole or part of the light-sensitive element can be delaminated from the dye fixing element, if desired. (Formats of this kind are disclosed, e.g., in JP-A-56-67840 and Canadian Patent 674,082.)

Another format of a color diffusion transfer photographic film unit of the type which has elements integrated into a unit but separated after the formation of the transferred image, is disclosed in JP-A-63-226649. This film unit comprises a light-sensitive element having on a White support, in sequence, at least (a) a layer having a neutralizing function, (b) a dye image-receiving layer, (c) a release layer and (d) at least one silver halide emulsion layer associated with a dye image-forming material, an alkaline processing composition containing a light-intercepting agent, and a transparent cover sheet. In addition, the emulsion layer is provided with a layer having a light-intercepting function on the side opposite to the surface on which the processing composition is spread.

In a format of another film unit of the non-peel-apart type, a light-sensitive element as described above is provided on a transparent support, a white reflective layer is coated thereon, and an image-receiving layer is further superposed thereon. On the other hand, U.S. Pat. No. 3,730,718 discloses a format of a film unit of the peel-apart type which comprises a support having thereon, in sequence, an image-receiving layer, a white reflecting layer, a release layer and a light-sensitive element. In this type of unit, the light-sensitive element is intentionally delaminated from the dye fixing element.

Additionally, there are two typical formats with respect to a film unit of the kind which has two separate supports on which a light-sensitive element and a dye fixing element are provided, respectively. In one format, the film unit is of the peel-apart type, while the other format is of the non-peel-apart type. More specifically, in a preferred embodiment of the film unit of the peel-apart type, one support has thereon an image-fixing element comprising at least one image-receiving layer (or mordanting layer) and the other support, which is provided with a light-intercepting layer, has thereon a light-sensitive element and, further, the film unit is designed so that the light-sensitive layer may be brought into face-to-face contact with the image-receiving layer by being turned inside out after completion of exposure (e.g., during development-processing), although these layers do not face each other before the exposure is completed. The light-sensitive element is separated from the image-fixing element quickly after the image is completely transferred in the mordanting layer.

In a preferred embodiment of the film units of the non-peel-apart type, at least one mordanting layer is coated on a transparent support, a light-sensitive element is provided on a transparent support or a support coated with a light-intercepting layer, and the mordanting layer is superposed on the light-sensitive element so that it may face the light-sensitive layer side of the light-sensitive element.

In the above-described formats, every film unit may be combined with a pressure rupturable container retaining an alkaline processing solution (or a processing element). With respect to the film unit of the non-peel-apart type wherein a dye fixing element and a light-sensitive element are laminated on the same support, it is desirable that the processing element be disposed between the light-sensitive element and a cover sheet superposed thereon. With respect to the film unit wherein a light-sensitive element and a dye-fixing element are provided on separate supports, it is desirable that the processing element be arranged between the light-sensitive element and the dye fixing element at the time of development-processing at the latest. It is advantageous that the processing element contains a light-intercepting agent (e.g., carbon black, dyes which change color depending on pH) and/or a white pigment (e.g., titanium dioxide) according to the format of the film unit. Further, it is desirable for the film unit according to the color diffusion transfer process that a neutralization timing mechanism comprising a neutralizing layer and a neutralization timing layer be incorporated in a cover sheet, a dye fixing element or a light-sensitive element.

When the present invention is applied to a color diffusion transfer process, dye image-forming materials suitable for the light-sensitive element include non-diffusible compounds capable of releasing a diffusible dye (or a precursor thereof), or capable of changing their own diffusibility in relation to silver development, which are described in *The Theory of The Photographic Process,* 4th edition. All of such compounds can be represented by the following general formula (A):

DYE-Y (A)

wherein DYE represents a dye moiety or a precursor thereof, and Y represents a constituent capable of producing a compound differing in diffusibility from the original compound under an alkaline condition. These compounds can be classified roughly into two groups, namely a group of negative-type compounds which become diffusible in the silver-developed area, and a group of positive-type compounds which become diffusible in the undeveloped area, depending on the function of Y.

Examples of a negative-type of Y constituent include those capable of being cleaved through oxidation as a result of development to release a diffusible dye. Specific examples of such a type of Y constituent are disclosed in U.S. Pat. Nos. 3,928,312, 3,993,638, 4,076,529, 4,152,153, 4,055,428, 4,053,312, 4,198,235, 4,179,291, 4,149,892, 3,844,785, 3,443,943, 3,751,406, 3,443,939, 3,443,940, 3,628,952, 3,980,479, 4,183,753, 4,142,891, 4,278,750, 4,139,379, 4,218,368, 3,421,964, 4,199,355, 4,199,354, 4,135,929, 4,336,322 and 4,139,389, JP-A-53-50736, JP-A-51-104343, JP-A-54-130122, JP-A-53-110827, JP-A-56-12642, JP-A-56-16131, JP-A-57-4043, JP-A-57-650, JP-A-57-20735, JP-A-53-69033, JP-A-54-130927, JP-A-56-164342, JP-A-57-119345, and so on.

Among negative type dye-releasing redox compounds from which Y is derived, N-substituted sulfamoyl groups (examples of a substituent group attached to the N atom include groups derived from aromatic hydrocarbon rings or heterocyclic rings) are preferred over others. Typical examples of Y are illustrated below. However, the invention should not be construed as being limited to these groups.

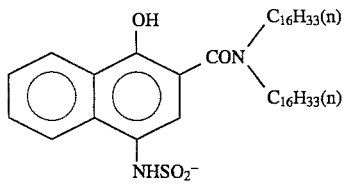

-continued

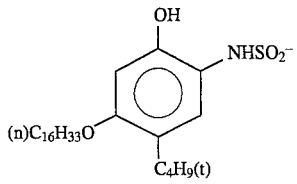

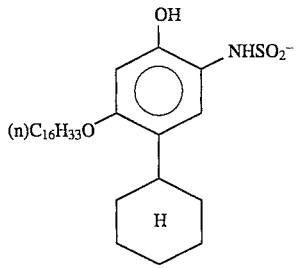

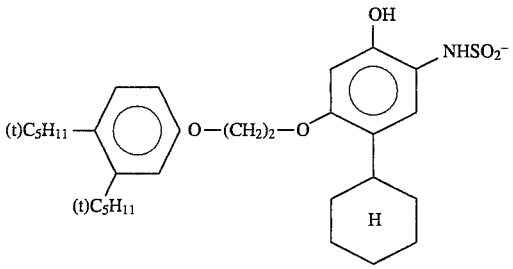

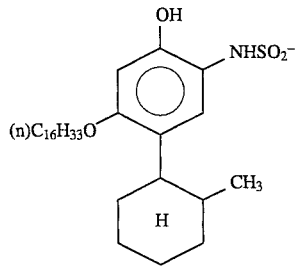

On the other hand, positive-type compounds are described in *Angew. Chem. Intl. Ed. Engl.,* 22, 191 (1982).

Specific examples of positive-type compounds include compounds which, though diffusible at the beginning under an alkaline condition, become nondiffusible when oxidized by development-processing (dye developing agents). Typical examples of Y effective as such compounds include those disclosed in U.S. Pat. No. 2,983,606.

Other specific examples of positive-type compounds include compounds of the kind which, though they release a diffusible dye through, e.g., self ring-closure under an alkaline condition, substantially cease releasing the dye when oxidized upon development. Specific examples of Y derived from the compounds having this function are disclosed, e.g., in U.S. Pat. No. 3,980,479, JP-A-53-69033, JP-A-54-130927, and U.S. Pat. Nos. 3,421,964 and 4,199,355.

Still other examples of positive-type compounds include compounds which, though they do not release any dye by themselves, release a dye when reduced. Such compounds are employed in combination with an electron donor, and thereby it becomes possible for them to release imagewise a diffusible dye by the reaction with electron donor molecules remaining without undergoing imagewise oxidation caused by silver development. Groups having this function as described above are disclosed, e.g., in U.S. Pat. Nos. 4,183,753, 4,142,891, 4,278,750, 4,139,379 and 4,218,368; JP-A-

53-110827; U.S. Pat. Nos. 4,278,750, 4,356,249 and 4,358,525; JP-A-53-827; JP-A-54-130927; JP-A-56-164342; Kokai Giho 87-6199; and EP-A2-0220746. Specific examples of Y derived from such compounds as cited above are illustrated below. However, the invention should not be construed as being limited to these examples.

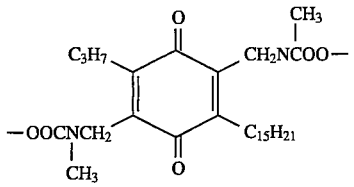

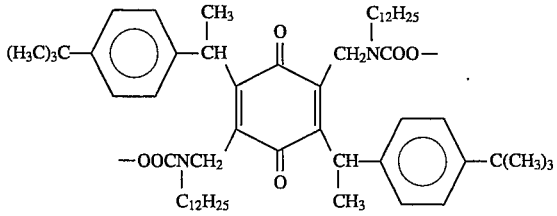

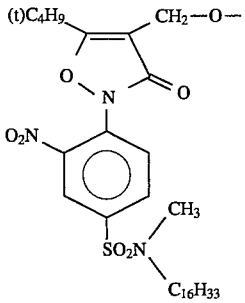

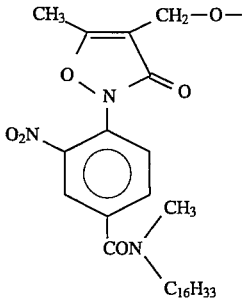

When the type of above-illustrated compounds are employed, it is preferable, as noted above, that they should be used in combination with a nondiffusible electron donating compound (known as an ED compound) or a precursor thereof. Specific examples of an ED compound are disclosed in U.S. Pat. Nos. 4,263,393 and 4,278,750, JP-A-56-138736, and so on.

Another type of dye image-forming materials are illustrated below:

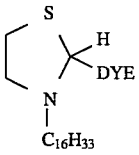

-continued

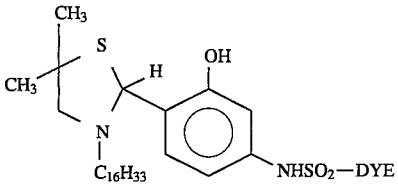

wherein DYE represents a dye or a precursor thereof the same as in the aforementioned general formula (A).

Details of such materials are described in U.S. Pat. Nos. 3,719,489 and 4,098,783.

Further, other specific examples of dye moieties represented by DYE in the foregoing general formulae are described in the references cited below.

More specifically, suitable examples relating to yellow dyes include those described in U.S. Pat. Nos. 3,597,200, 3,309,199, 4,013,633, 4,245,028, 4,156,609, 4,139,383, 4,195,992, 4,148,641, 4,148,643 and 4,336,322; JP-A-51-114930, JP-A-56-71072; *Research Disclosure,* No. 17630 (1978), and *Research Disclosure,* No. 16475 (1977).

Suitable examples relating to magenta dyes include those described in U.S. Pat. Nos. 3,453,107, 3,544,545, 3,932,380, 3,931,144, 3,932,308, 3,954,476, 4,233,237, 4,255,509, 4,250,246, 4,142,891, 4,207,104 and 4,287,292; JP-A-52-106727, JP-A-53-23628, JP-A-55-36804, JP-A-56-73057, JP-A-56-71060 and JP-A-55-134.

Suitable examples relating to cyan dyes include those described in U.S. Pat. Nos. 3,482,972, 3,929,760, 4,013,635, 4,268,625, 4,171,220, 4,242,435, 4,142,891, 4,195,994, 4,147,544 and 4,148,642; British Patent 1,551,138; JP-A-54-99431, JP-A-52-8827, JP-A-53-47823, JP-A-53-143323, JP-A-54-99431, JP-A-56-71061; European Patents (EPC) 53,037 and 53,040; and *Research Disclosure,* No. 17630 (1978) and *Research Disclosure,* No. 16475 (1977).

Silver halide emulsions suitably used in the present invention in the context of a color diffusion transfer process may be either negative emulsions which form latent images predominantly at the surface of the grains, or internal latent-image type direct positive emulsions which mainly form latent images inside the grains.

The emulsions of the latter kind may be, e.g., so-called "conversion type" emulsions which are prepared by taking advantage of the difference in solubility among silver halides, or "core/shell" type emulsions which are prepared by covering, with a shell of silver halides, at least light-sensitive sites of core grains comprising silver halides which have undergone doping with metal ion(s), chemical sensitization or both of these treatments. These types of emulsions are disclosed, e.g., in U.S. Pat. Nos. 2,592,250 and 3,206,313; British Patent 1,027,146; U.S. Pat. Nos. 3,761,276, 3,935,014, 3,447,927, 2,497,875, 2,563,785, 3,551,662 and 4,395,478; German Patent 2,728,108; and U.S. Pat. No. 4,431,730.

When internal latent-image type direct positive emulsions are used, it is necessary to provide fogged nuclei to the grain surface using light or a nucleating agent after imagewise exposure.

Suitable examples of a nucleating agent used for the above-described purpose include the hydrazines disclosed in U.S. Pat. Nos. 2,563,785 and 2,588,982; the hydrazides and the hydrazines disclosed in U.S. Pat. No. 3,227,552; the heterocyclic quaternary salt compounds as disclosed in British Patent 1,283,835, JP-A-52-69613, U.S. Pat. Nos. 3,615,615, 3,719,494, 3,734,738, 4,094,683 and 4,115,122, and so on; the sensitizing dyes disclosed in U.S. Pat. No. 3,718,470, which contain a substituent group having-a nucleating function in a dye molecule; the acylhydrazine compounds containing a thiourea linkage, as disclosed in U.S. Pat. Nos. 4,030,925, 4,031,127, 4,245,037, 4,255,511, 4,266,013 and 4,276,364, British Patent 2,012,443, and so on; the acylhydrazine compounds to which a heterocyclic group such as a thioamide ring, a triazolyl group or a tetrazolyl group is attached as an adsorbing group, as disclosed, e.g., in U.S. Pat. Nos. 4,080,270 and 4,278,748, and British Patent 2,011,391B; and so on.

In the present invention, spectral sensitizing dyes are used in combination with the aforementioned negative emulsions and internal latent-image type direct positive emulsions. Specific examples thereof are disclosed, e.g., in JP-A-59-180550, JP-A-60-140335; *Research Disclosure* (RD), No. 17029; U.S. Pat. Nos. 1,846,300, 2,078,233, 2,089,129, 2,165,338, 2,231,658, 2,917,516, 3,352,857, 3,411,916, 2,295,276, 2,481,698, 2,688,545, 2,921,067, 3,282,933, 3,397,060, 3,660,103, 3,335,010, 3,352,680, 3,384,486, 3,623,881, 3,718,470 and 4,025,349; and so on.

For reproduction of natural colors according to the subtractive color process, at least two light-sensitive layers are employed wherein emulsions sensitized by spectral sensitizing dyes as described above are associated with dye image-forming materials as described above which can provide dyes having selective spectral absorption in the same wavelength regions as their corresponding emulsions, respectively. An emulsion and a dye image-forming material used in combination may be coated in separate layers superposed on each other, or mixed with each other and coated in a single layer. When the dye image-forming material in a coated condition absorbs light in the wavelength region wherein the emulsion used in combination therewith has spectral sensitivities, it is preferred to coat them in separate layers. Moreover, the emulsion layer itself may comprise a plurality of layers differing in sensitivity. In addition, another layer may be sandwiched in between the emulsion layer and the dye image-forming material layer, if desired. For instance, a layer containing a nucleation development accelerator as disclosed in JP-A-60-173541 or a partition layer as disclosed in JP-B-60-15267 (the term "JP-B" as used herein means an "examined Japanese patent publication") can be provided to heighten the color image density, or a reflecting layer as disclosed in JP-A-60-91354 can be provided to heighten the sensitivity of the light-sensitive element.

In a preferred multilayer structure, a combined unit of a blue-sensitive emulsion with a yellow dye-providing material, a combined unit of a green-sensitive emulsion with a magenta dye-providing material, and a combined unit of a red-sensitive emulsion with a cyan dye-providing material are arranged successively from the exposure side.

An arbitrary layer, depending on desired function, can be arranged between every two adjacent units, if needed. For instance, it is advantageous to arrange an interlayer having a silver ion capture function when compounds capable of releasing a diffusible dye by the reaction with silver ion, as disclosed in JP-B-55-7576, are used in such units.

In addition, an irradiation inhibiting layer, a partition layer, a protective layer and so on may be provided, if desired.

A processing composition used in the present invention is spread uniformly over a light-sensitive element after the exposure of the light-sensitive element in such a manner so as to completely screen the light-sensitive layers from daylight in co-operation with a light-intercepting layer arranged on the back side of the support or on the side opposite to the processing composition-spread side of the light-sensitive element, and at the same time to effect the development of the light-sensitive layers with ingredients contained therein. Therefore, the composition contains alkalis, a thickener, a light-intercepting agent, a developing agent, a development accelerator and a development retarder for controlling the progress of development, and furthermore an antioxidant or the like for preventing the developing agent from deteriorating.

The alkalis serve to adjust the processing composition to pH 12 to 14, with specific examples including hydroxides of alkali metals (such as sodium hydroxide, potassium hydroxide and lithium hydroxide), phosphates of alkali metals (such as potassium phosphate), guanidines, hydroxides of quaternary amines (such as tetramethylammonium hydroxide). Of these alkalis, potassium hydroxide and sodium hydroxide are preferred over others.

The thickener is required for uniformly spreading the processing composition and for retaining adhesiveness between the light-sensitive layer and the cover sheet when the light-sensitive layer which has performed its role is peeled apart together with the cover sheet. Suitable examples thereof include polyvinyl alcohol, hydroxyethyl cellulose, and alkali metal salts of carboxymethyl cellulose. In particular, hydroxyethyl cellulose and sodium carboxymethyl cellulose are advantageous.

With respect to the light-intercepting agent, any conventional dyes, pigments or mixtures thereof can be used unless they diffuse into the dye image-receiving layer to generate stain. One typical example of the light-intercepting agent is carbon black, but combinations of titanium white with dyes can also be used. Such dyes may include temporarily light-intercepting dyes which become colorless with the lapse of a definite time after the development-processing.

Any developing agent can be used favorably so long as it can cause cross-oxidation of dye image-forming materials and does not substantially generate stain even when oxidized. Such developing agents may be used alone or as a mixture of two or more thereof. Also, they may be used in the form of precursors. Additionally, they may be incorporated in an appropriate layer of the light-sensitive element, or may be contained in an alkaline processing solution. Concrete examples of such developing agents include aminophenols and pyrazolidinones. Of these compounds, pyrazolidinones are preferred in particular because generation of stain can be reduced.

Specific examples of pyrazolidinones which can be used to greater advantage include 1-phenyl-3-pyrazolidinone, 1-p-tolyl-4,4-dihydroxymethyl-3-pyrazolidinone, 1-(3'-methylphenyl)-4-methyl-4-hydroxymethyl-3-pyrazolidinone, 1-phenyl-4-methyl-4-hydroxymethyl-3-pyrazolidinone, 1-p-tolyl-4-methyl-4-hydroxymethyl-3-pyrazolidinone and the like.

It is desired that the color diffusion transfer photographic film unit to which the present invention is applied should be designed so as to have a neutralization function between the support and the light-sensitive layer, or between the support and the image-receiving layer, or on the cover sheet.

The layer having such a neutralization function is a layer containing an acidic material in an amount sufficient to neutralize the alkalis carried thereinto from the processing composition. The layer may have a multilayer structure comprising a neutralizing rate controlling layer (or a timing layer), an adhesiveness intensifying layer and so on, if desired. With respect to the acidic material, those containing an acidic group of pKa 9 or below (or a precursor group capable of producing such an acidic group by hydrolysis) are preferred. Specific examples of more preferable acidic materials include higher fatty acids such as oleic acid, as described in U.S. Pat. No. 2,983,606; acrylic, methacrylic or maleic acid polymers, and partial esters or acid anhydrides thereof, as disclosed in U.S. Pat. No. 3,362,819; acrylic acid/acrylate copolymers as disclosed in French Patent 2,290,699; and acid polymers of the latex type as disclosed in U.S. Pat. No. 4,139,383 and *Research Disclosure,* No. 16102 (1977).

In addition, acidic materials as disclosed in U.S. Pat. No. 4,088,493, JP-A-52-153739, JP-A-53-1023, JP-A-53-4540, JP-A-53-4541, JP-A-53-4542 and so on can be employed.

Specific examples of acidic polymers include a copolymer of a vinyl monomer, such as ethylene, vinyl acetate, vinyl methyl ether or the like, and maleic anhydride, an n-butyl ester of such a copolymer, a copolymer of butyl acrylate and acrylic acid, cellulose acetate hydrogenphthalate, and so on.

The above-cited polymeric acids can be used in the form of mixture with hydrophilic polymers. Examples of such hydrophilic polymers include polyacrylamide, polymethylpyrrolidone, polyvinyl alcohol (including partially saponified ones), carboxymethyl cellulose, hydroxymethyl cellulose, hydroxyethyl cellulose, polymethyl vinyl ether, and so on. Among these polymers, polyvinyl alcohol is most preferred.

The coverage of the polymeric acid is controlled depending on the amount of alkalis to be spread over the light-sensitive element. A desirable equivalent weight ratio between the polymeric acid and alkalis per unit area ranges from 0.9 to 2.0. When the amount of the polymeric acid used is too small, a change in hue is caused in the transferred dyes and stain is generated in a white background, whereas the use of a polymeric acid in a too large amount has a disadvantage of changing the hue of transferred dyes, causing the deterioration of light fastness, or so on. A more favorable equivalent weight ratio is within the range of 1.0 to 1.3. Hydrophilic polymers to be mixed with the polymeric acids may cause the deterioration of photographic qualities, whether the amount used is too large or too small. Accordingly, a suitable ratio of the hydrophilic polymers to the polymeric acids ranges from 0.1 to 10, preferably from 0.3 to 3.0, by weight.

In the layer having a neutralizing function, additives can be incorporated for various purposes. For instance, known hardeners can be added for the purpose of hardening the layer, and polyhydric hydroxyl compounds such as polyethylene glycol, polypropylene glycol, glycerol and the like can be added for the purpose of improving the brittleness of the film formed. Further, an antioxidant, a brightening agent, dyes for imparting a tinge of blue to the layer and so on can be added, if needed.

For the timing layer used in combination with the neutralizing layer, polymers capable of lowering the permeability of an alkali, such as gelatin, polyvinyl alcohol, partial acetals of polyvinyl alcohol, cellulose acetate, partially hydrolyzed polyvinyl acetate, etc.; latex polymers capable of heightening the activation energy for permeation of an alkali, in which a hydrophilic comonomer such as acrylic acid monomer is copolymerized in a small fraction; polymers containing lactone rings; and so on are useful.

More specifically, timing layers in which cellulose acetate is used, as disclosed in JP-A-54-136328, and U.S. Pat. Nos. 4,267,262, 4,009,030 and 4,029,849; latex polymers prepared by using a hydrophilic comonomer such as acrylic acid in a small fraction in copolymerization, as disclosed in JP-A-54-128335, JP-A-56-69629, JP-A-57-6843, and U.S. Pat. Nos. 4,056,394, 4,061,496, 4,199,362, 4,250,243, 4,256,827 and 4,268,604; polymers containing lactone rings disclosed in U.S. Pat. No. 4,229,516; and polymers disclosed in JP-A-56-25735, JP-A-56-97346, JP-A-57-6842, EP-A1-031957, EP-A1-037724, EP-A1-048412 and so on, are especially useful.

In addition, those described in the following documents can be used, too: U.S. Pat. Nos. 3,421,893, 3,455,686, 3,575,701, 3,778,265, 3,785,815, 3,847,615, 4,088,493, 4,123,275, 4,148,653, 4,201,587, 4,288,523 and 4,297,431; German Patent Application (OLS) Nos. 1,622,936 and 2,162,277; *Research Disclosure,* No. 15162 (1976).

The timing layers using materials as described above can be used in the form of single layer, or as a combination of two or more of such layers.

Moreover, it is possible to incorporate in the timing layers comprising the materials as described above, development inhibitors and/or precursors thereof, as disclosed, e.g., in U.S. Pat. No. 4,009,029, German Patent Application (OLS) Nos. 2,913,164 and 3,014,672, JP-A-54-155837, JP-A-55-138745 and so on, hydroquinone precursors disclosed in U.S. Pat. No. 4,201,578, and other photographically useful additives or precursors thereof.

The present invention will be described in more detail by reference to the following Examples. However, the invention should not be construed as being limited to these examples.

EXAMPLE 1

First, preparation of silver halide emulsions used herein is described below.

Preparation of Tabular Silver Bromide Emulsion:

One l of a 0.8 wt % aqueous gelatin solution containing 0.08M of potassium bromide was stirred, and thereto were added simultaneously 150 ml of a water solution containing 2.00M silver nitrate and 150 ml of a water solution containing 2.00M potassium bromide in accordance with a double jet method. During the addition the gelatin solution was kept at 30° C. At the conclusion of the addition, the temperature of the solution was raised to 75° C. and 30 g of gelatin was further added thereto.

After the first stage of addition as described above was finished, 90 ml of a water solution of 1.0M silver nitrate was added. Then, the mixture was allowed to stand for 30 min. to effect ripening. The thus formed grains (which are called "seed grains", hereinafter) were washed in accordance with a conventional flocculation method, and the resulting emulsion were adjusted to pH 5.0 and pAg 7.5.

A one-tenth portion of the thus treated seed grains was dissolved in 1 l of a water solution containing 3 wt % gelatin, and the temperature of the solution was kept at 75° C. Therein, the pBr of the solution was maintained at 1.60. To this solution, 150 g of silver nitrate was added over a 60-minute period at an increasing flow rate (such that the flow rate at the conclusion of addition was 19 times that at the beginning). During the addition the pBr was maintained at 1.60.

Further, silver nitrate was added so that the pBr became 2.70 in the presence of ammonium thiocyanate.

Thereafter, the emulsion was cooled to 35° C., washed using a conventional flocculation method, adjusted to pH 6.5 and pAg 8.6 at 40° C., and preserved in a cold and dark place. The thus formed tabular grains had an average grain diameter of 1.3 μm (the term "grain diameter" as used herein refers to the diameter of the circle having the same area as the projected area of each grain) and an average thickness of 0.25 μm.

Preparation of Emulsion for Red-Sensitive Layer:

The above-described tabular silver bromide emulsion was heated to 55° C. and chemically ripened by adding thereto $Na_2SO_3$, $KAuCl_4$ and ammonium thiocyanate in the presence of sodium benzenethiosulfonate, the sensitizing dyes S-1 and S-2 illustrated below and 4-hydroxy-6-methyl-1,3, 3a,7-tetraazaindene. The temperature of the emulsion was lowered at the time when the maximum sensitivity was achieved, which terminated the chemical sensitization to prepare an emulsion for a red-sensitive layer. Added amounts of the sensitizing dyes S-1 and S-2, that of $Na_2SO_3$ and that of $KAuCl_4$ were determined respectively so that the sensitivity attained would be maximal.

Preparation of Emulsion for Green-Sensitive Layer:

An emulsion for a green-sensitive layer was prepared in the same manner as that for a red-sensitive layer, except that the sensitizing dye S-3 was used in place of the sensitizing dyes S-1 and S-2.

Preparation of Emulsion for Blue-Sensitive Layer:

An emulsion for a blue-sensitive layer was prepared in the same manner as that for a red-sensitive layer, except that the sensitizing dye S-4 was used in place of the sensitizing dyes S-1 and S-2.

Sensitizing Dye S-1

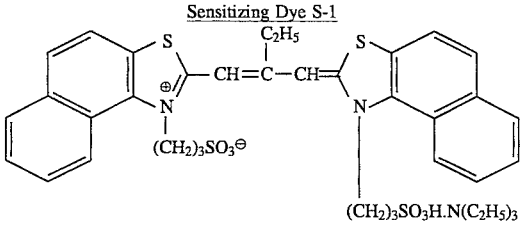

Sensitizing Dye S-2

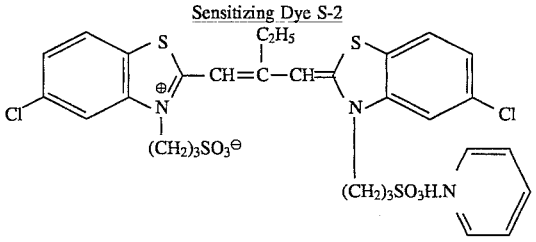

Sensitizing Dye S-3

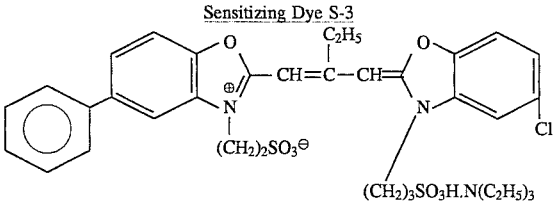

Sensitizing Dye S-4

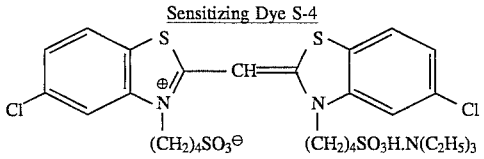

Next, preparation of gelatin dispersions of dye providing compounds is described below.

Eighteen grams of the yellow dye-providing compound (1)* and 12 g of the high boiling organic solvent (1)* were weighed out, admixed with 51 ml of ethyl acetate, and heated up to about 60° C. to dissolve the dye-providing compound in the solvent mixture. Thus, a homogeneous solution was obtained. This solution, 100 g of a 10% water solution of lime-processed gelatin, 60 ml of water and 1.5 g of sodium dodecylbenzenesulfonate were mixed with stirring, and made into a dispersion using a homogenizer for 10 minutes at 10,000 rpm. The thus prepared dispersion was named the dispersion of a yellow dye-providing compound.

A dispersion of a magenta dye-providing compound and that of a cyan dye-providing compound were prepared in the same manner as the dispersion of the yellow dye-providing compound, except that the magenta dye-providing compound (2)* and the cyan dye-providing compound (3)* were used, respectively, in place of the yellow dye-providing compound (1)*.

Preparation of a gelatin dispersion of an electron donor is described below.

20.6 g of the electron donor (1)* and 13.1 g of the high boiling organic solvent (1)* were weighed out, admixed with 120 ml of ethyl acetate, and heated up to about 60° C. to dissolve the electron donor in the solvent mixture. Thus, a homogeneous solution was obtained. This solution, 100 g of a 10% water solution of lime-processed gelatin, 60 ml of water and 1.5 g of sodium dodecylbenzenesulfonate were mixed with stirring, and made into a dispersion using a homogenizer for 10 minutes at 10,000 rpm. The thus prepared dispersion was named the dispersion of an electron donor.

Further, preparation of a gelatin dispersion of a nondiffusible reducing agent to be used for an interlayer is described below.

23.5 g of the nondiffusible reducing agent (1)* and 8.5 g of the high boiling organic solvent (1)* were weighed out, admixed with 120 ml of ethyl acetate, and heated up to about 60° C. to dissolve the reducing agent in the solvent mixture. Thus, a homogeneous solution was obtained. This solution, 100 g of a 10% water solution of lime-processed gelatin, 15 ml of a 5% aqueous solution of the surfactant (3)* and 0.2 g of sodium dodecylbenzenesulfonate were mixed with stirring, and made into a dispersion using a homogenizer for 10 minutes at 10,000 rpm. The thus prepared dispersion was named the dispersion of a nondiffusible reducing agent for an interlayer.

Using the foregoing emulsions and dispersions, a light-sensitive element 101 having a multilayer structure shown in the following Table 1 was prepared.

TABLE 1

Constitution of Light-Sensitive Element 101

| Ordinal Number of Layer | Name of Layer | Ingredients | Coverage ($g/m^2$) |
|---|---|---|---|
| 10th | Protective layer | Gelatin | 0.17 |
| | | Matting agent (1) | 0.09 |
| | | Hardener (1) | $1.9 \times 10^{-3}$ |
| | | Surfactant (1) | $4.5 \times 10^{-4}$ |
| | | Surfactant (2) | $5.0 \times 10^{-5}$ |
| | | Water-soluble polymer (1) | $3.6 \times 10^{-4}$ |
| 9th | UV absorbing layer | Gelatin | 0.47 |
| | | UV absorbent (1) | 0.14 |
| | | UV absorbent (2) | 0.13 |
| | | Surfactant (1) | $1.3 \times 10^{-3}$ |
| | | Water-soluble polymer (1) | $1.4 \times 10^{-4}$ |
| 8th | Blue-sensitive layer | Emulsion E3 | 0.23* |
| | | Gelatin | 0.34 |
| | | Surfactant (1) | $6.7 \times 10^{-3}$ |
| | | Water-soluble polymer (1) | $1.4 \times 10^{-2}$ |
| 7th | Yellow color material layer | Yellow dye-providing material (1) | 0.37 |
| | | Electron donor (1) | 0.20 |
| | | Gelatin | 0.53 |
| | | High boiling organic | 0.37 |

TABLE 1-continued

Constitution of Light-Sensitive Element 101

| Ordinal Number of Layer | Name of Layer | Ingredients | Coverage (g/m$^2$) |
|---|---|---|---|
| | | solvent (1) | |
| | | Water-soluble polymer (1) | $6.5 \times 10^{-3}$ |
| 6th | Interlayer | Nondiffusible reducing agent (1) | 0.45 |
| | | High boiling organic solvent (1) | 0.16 |
| | | Gelatin | 0.68 |
| | | Surfactant (2) | $6.5 \times 10^{-2}$ |
| | | Water-soluble polymer (1) | $1.9 \times 10^{-2}$ |
| 5th | Green-sensitive layer | Emulsion E2 | 0.23* |
| | | Gelatin | 0.34 |
| | | Surfactant (1) | $6.7 \times 10^{-3}$ |
| | | Water-soluble polymer (1) | $1.4 \times 10^{-2}$ |
| 4th | Magenta color material layer | Magenta dye-providing material (2) | 0.33 |
| | | Electron donor (1) | 0.13 |
| | | Gelatin | 0.38 |
| | | High boiling organic solvent (1) | 0.27 |
| | | Water-soluble polymer (1) | $4.3 \times 10^{-3}$ |
| 3rd | Interlayer | Nondiffusible reducing agent (1) | 0.45 |
| | | High boiling organic solvent (1) | 0.16 |
| | | Gelatin | 0.68 |
| | | Surfactant (2) | $6.5 \times 10^{-2}$ |
| | | Water-soluble polymer (1) | $1.9 \times 10^{-2}$ |
| 2nd | Red-sensitive layer | Emulsion E1 | 0.23* |
| | | Gelatin | 0.34 |
| | | Surfactant (1) | $6.7 \times 10^{-2}$ |
| | | Water-soluble polymer (1) | $1.4 \times 10^{-2}$ |
| 1st | Cyan color material layer | Cyan dye-providing material (3) | 0.38 |
| | | Electron donor (1) | 0.13 |
| | | Gelatin | 0.38 |
| | | High boiling organic solvent (1) | 0.27 |
| | | Water-soluble polymer (1) | $4.3 \times 10^{-3}$ |
| Support (100 μm-thick polyethylene terephthalate film) | | | |
| Backing layer | | Carbon black | 4.0 |
| | | Gelatin | 2.0 |

*coverage based on silver.

Materials mentioned in the foregoing description are described further below.

Matting agent (1)*

Spherical polymethyl methacrylate latex (average particle size: 4 μm)

UV absorbent (1)*

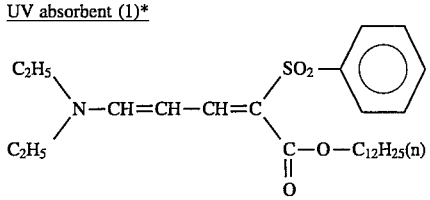

UV absorbent (2)*

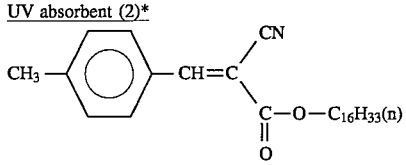

Water-soluble polymer (1)*

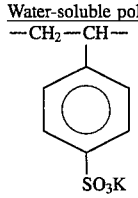

Surfactant (1)*

Aerosol OT

Surfactant (2)*

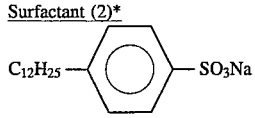

High boiling organic solvent (1)*

-continued
Tricyclohexyl phosphate
Hardener (1)*
1,2-Bis(vinylsulfonylacetamido)ethane
Nondiffusible reducing agent (1)*
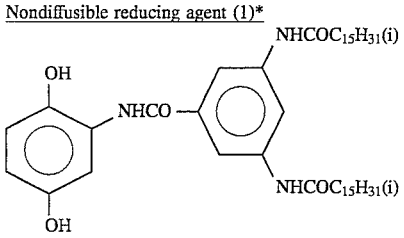
Electron donor (1)*
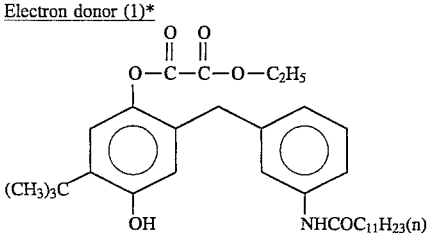
Yellow dye-providing compound (1)*
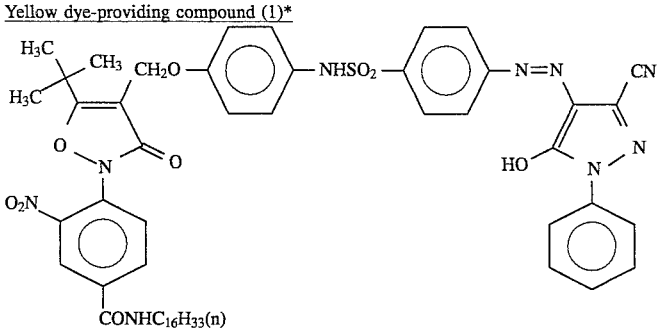
Magenta dye-providing compound (2)*
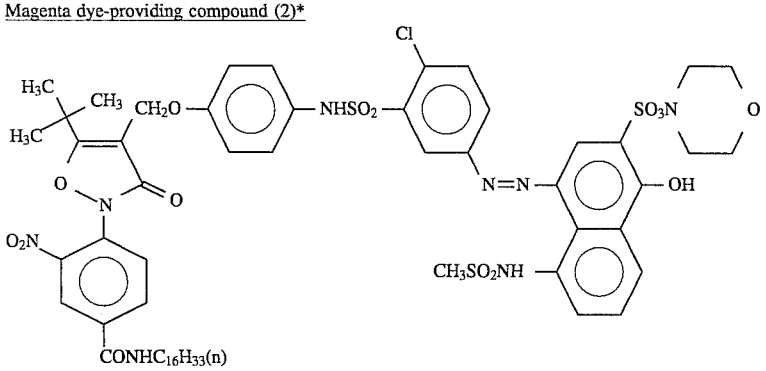
Cyan dye-providing compound (3)*
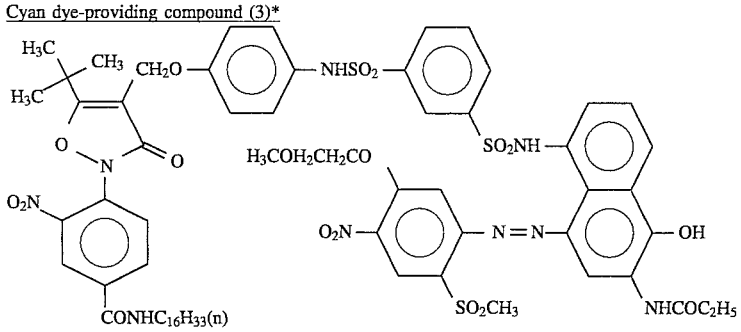
Preparation of Dye. Fixing Elements:

A dye fixing element for comparison (201) and dye-fixing elements of the present invention (from 202 to 210), each of which had a multilayer structure as shown in Table 2-A and contained mordants as set forth in Table 2-B, were prepared. Every layer in these dye fixing elements was hardened with a hardener.

TABLE 2-A

| Constitution of Dye fixing Element | | | |
|---|---|---|---|
| Ordinal Number of Layer | Name of Layer | Ingredients | Coverage ($g/m^2$) |
| F 6th | Protective | Gelatin | 0.6 |
| F 5th | Mordanting layer | Gelatin | 3.0 |
| | | Mordant (See Table 2-B) | See Table 2-B |
| | | Coating aid | |
| F 4th | Timing layer (1) | Polymer latex (1) | 0.96 |
| | | Polymer latex (2) | 0.64 |
| F 3rd | Interlayer | Poly(2-hydroxyethyl methacrylate) | 0.4 |
| F 2nd | Timing layer (2) | Cellulose acetate (acetylation degree: 51.3%) | 4.27 |
| | | Styrene/maleic anhydride (1:1 by mole) copolymer (average molecular weight: 10,000) | 0.23 |
| F 1st | Neutralizing layer | Acrylic acid/butyl acrylate (8:2 by mole) copolymer (average molecular weight: 50,000) | 22 |
| 150 μm-thick paper support (laminated by 30 μm-thick polyethylene film on both sides) | | | |
| B 1st | Light-intercepting layer | Gelatin | 2.0 |
| | | Carbon black | 4.0 |
| B 2nd | White layer | Gelatin | 1.0 |
| | | Titanium dioxide | 8.0 |
| B 3rd | Protective layer | Gelatin | 0.6 |

Polymer latex (1) was obtained by copolymerizing styrene, butyl acrylate, acrylic acid and N-methylolacrylamide in a ratio of 49.7/42.3/4/4 by weight in accordance with an emulsion polymerization method.

Polymer latex (2) was obtained by copolymerizing methyl methacrylate, acrylic acid and N-methylolacrylamide in a ratio of 93/3/4 by weight in accordance with an emulsion polymerization method.

The coating aid used is represented by the following formula:

TABLE 2-B

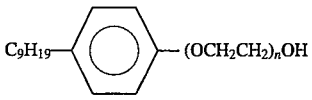

(N = 30)

| Dye fixing Element | Mordant | Coverage ($g/m^2$) |
|---|---|---|
| 201 (comparison) | Mordant (1) | 2.0 |
| 202 (invention) | Compound 1 | 2.7 |
| 203 (invention) | Compound 3 | 2.5 |
| 204 (invention) | Compound 4 | 3.2 |
| 205 (invention) | Compound 5 | 2.4 |
| 206 (invention) | Compound 6 | 2.8 |
| 207 (invention) | Compound 7 | 2.5 |
| 208 (invention) | Compound 11 | 2.8 |
| 209 (invention) | Compound 13 | 2.3 |
| 210 (invention) | Compound 15 | 2.3 |
| Mordant (1) | | |

TABLE 2-B-continued

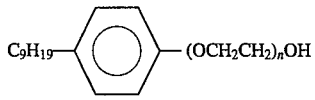

(N = 30)

| Dye fixing Element | Mordant | Coverage ($g/m^2$) |
|---|---|---|

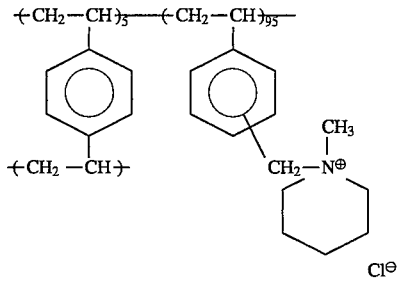

Additionally, the dye fixing element 201 contained the mordant (Mordant (1)) disclosed in JP-A-59-232340, which suppressed photo-discoloration of the dyes fixed thereto.

The processing composition used is described below.

A 0.8 g portion of the processing composition described below was charged in a rupturable container.

| | |
|---|---|
| 1-p-Tolyl-4-hydroxymethyl-4-methyl-2-pyrazolidone | 10.0 g |
| 1-Phenyl-4-hydroxymethyl-4-methyl-3-pyrazolidone | 4.0 g |
| Potassium sulfite (anhydrous) | 4.0 g |
| Hydroxyethyl cellulose | 40 g |
| Potassium hydroxide | 64 g |
| Water to make the total weight | 1 Kg |

Evaluation of Light Fastness of Images (Discoloration Test):

Regarding each of cyan, magenta and yellow color images, the light-sensitive element 101 described above was exposed to light from the emulsion layer side under a condition that such a monochrome image having stepwise changing density was formed therein. The light-sensitive layer of the exposed light-sensitive element was brought into face-to-face contact with the image-receiving layer of each of the dye fixing elements 201 to 210, and then the foregoing processing composition was spread in a 60 μm-thick layer between both the elements by means of a pressure-applying roller. The composition-spreading process was carried out at 25° C. After 90-seconds, the light-sensitive element 101 was separated from the dye fixing element.

Reflection density of each color image transferred to each dye fixing element was measured with a Model X-Rite 310 densitometer. Further, each dye fixing element was exposed to light emitted from a xenon lamp, and after 3-days the reflection density of the color image remaining on the dye fixing element was measured. Then, a graph was made showing the dye remaining rate after the discoloration test on the vertical axis, and density before the discoloration test horizontally. Therefrom, the dye remaining rate in the part having an image density of 1.0 before the discoloration test was determined. The thus determined dye remaining rates of individual color images are shown in Table 3.

Evaluation of Mordanting Power (Competition Test):

The light-sensitive layer of the unexposed light-sensitive element 101 was brought into face-to-face contact with the image-receiving layer of the dye fixing element 201, and then the foregoing processing composition was spread in a 60 μm-thick layer between both the elements by means of a pressure-applying roller. The composition-spreading process was carried out at 25° C. After 90-seconds, the light-sensitive element 101 was separated from the dye fixing element 201. Then, water was applied to the image-receiving layer side on which black color image (black solid image) was formed by the foregoing operation. The resulting image-receiving layer was brought into face-to-face contact with the image-receiving layer of each of the dye fixing elements 201 to 210, heated up to 83° C. kept at this temperature for 25 seconds, and then separated.

With respect to the reflection densities of color images transferred to the dye fixing elements 201 to 210, visual densities were measured with a Model X-Rite 310 densitometer. The results obtained are also shown in Table 3.

The data regarding the foregoing test indicate that the mordant used has higher mordanting power the higher density the transferred color image has.

TABLE 3

Evaluation of Light Fastness and Mordanting Power

| Dye Fixing Element | Dye Remaining Rate | | | Competition |
|---|---|---|---|---|
| | Cyan | Magenta | Yellow | Test |
| 201 (comparison) | 0.43 | 0.77 | 0.89 | 0.39 |
| 202 (invention) | 0.65 | 0.86 | 0.92 | 0.65 |
| 203 (invention) | 0.59 | 0.82 | 0.93 | 0.58 |
| 204 (invention) | 0.63 | 0.83 | 0.91 | 0.56 |
| 205 (invention) | 0.71 | 0.89 | 0.95 | 0.55 |
| 206 (invention) | 0.70 | 0.85 | 0.93 | 0.60 |
| 207 (invention) | 0.64 | 0.86 | 0.91 | 0.64 |
| 208 (invention) | 0.60 | 0.79 | 0.96 | 0.71 |
| 209 (invention) | 0.75 | 0.85 | 0.93 | 0.67 |
| 210 (invention) | 0.59 | 0.81 | 0.91 | 0.53 |

As can be seen from the data shown in Table 3, the dye fixing elements of the present invention were strong in mordanting power and very excellent in light fastness of color images fixed thereto as compared with the dye fixing element containing the comparative mordant.

EXAMPLE 2

Another light-sensitive element 301 was prepared in the following manner.

Preparation of Light-Sensitive Element 301

Layers described below were coated on a transparent polyethylene terephthalate support to prepare a light-sensitive sheet.

On the back side of the support:

(a) A light-intercepting layer containing 4.0 g/m$^2$ of carbon black and 2.0 g/m$^2$ of gelatin. On the emulsion layer side of the support, in this order:

(1) A layer containing 0.44 g/m$^2$ of the following cyan dye-releasing redox compound, 0.09 g/m$^2$ of tricyclohexyl phosphate, 0,008 g/m$^2$ of 2,5-di-t-pentadecylhydroquinone and 0.8 g/m$^2$ of gelatin.

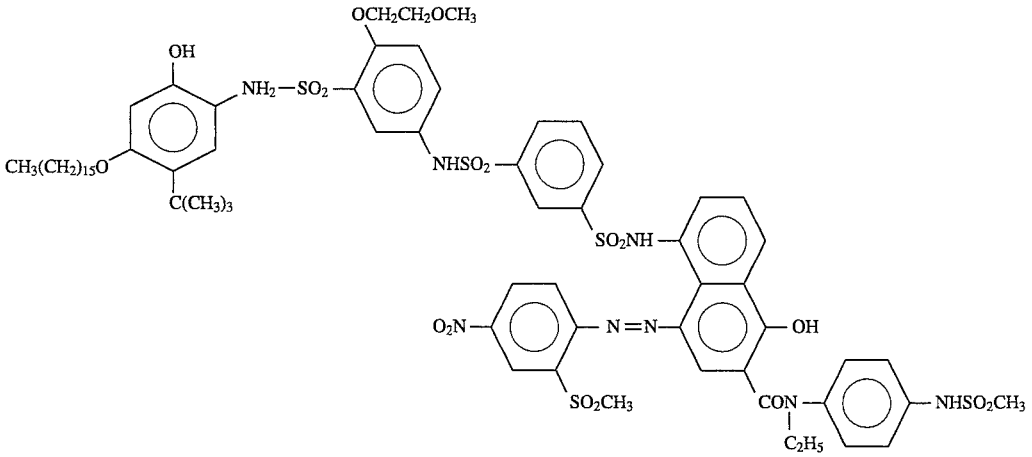

(2) A layer containing 0.5 g/m$^2$ of gelatin.

(3) A red-sensitive emulsion layer containing a red-sensitive internal latent-image type direct-positive silver bromide emulsion (0.6 g/m$^2$ on a silver basis), 1.2 g/m$^2$ of gelatin, 0.015 mg/m$^2$ of the following nucleating agent and 0.06 g/m$^2$ of sodium salt of 2-sulfo-5-n-pentadecylhydroquinone.

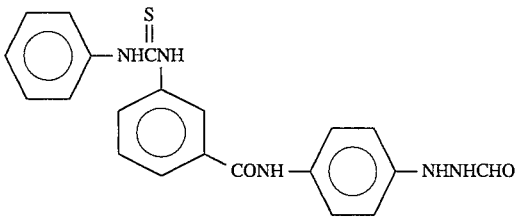

(4) A layer containing 0.43 g/m$^2$ of 2,5-di-t-pentadecylhydroquinone, 0.1 g/m$^2$ of trihexyl phosphate and 0.4 g/m$^2$ of gelatin.

(5) A layer containing 0.3 g/m$^2$ of the following magenta dye-releasing redox compound, 0.08 g/m$^2$ of tricyclohexyl phosphate, 0.009 g/m$^2$ of 2,5-di-t-pentadecylhydroquinone and 0.5 g/m$^2$ of gelatin.

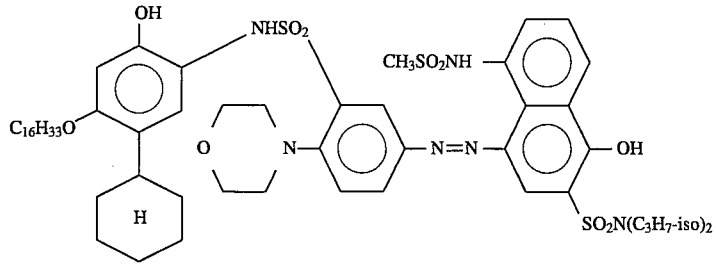

(6) A green-sensitive emulsion layer containing a green-sensitive internal latent-image type direct-positive silver bromide emulsion (0.42 g/m$^2$ on a silver basis), 0.9 g/m$^2$ of gelatin, 0.013 mg/m$^2$ of the same nucleating agent as used in layer (3) and 0.07 g/m$^2$ of sodium salt of 2-sulfo-5-n-pentadecylhydroquinone.

(7) The same layer as layer (4).

(8) A layer containing 0.53 g/m$^2$ of the following yellow dye-releasing redox compound, 0.13 g/m$^2$ of tricyclohexyl phosphate, 0.014 g/m$^2$ of 2,5-di-t-penta-decylhydroquinone and 0.7 g/m$^2$ of gelatin.

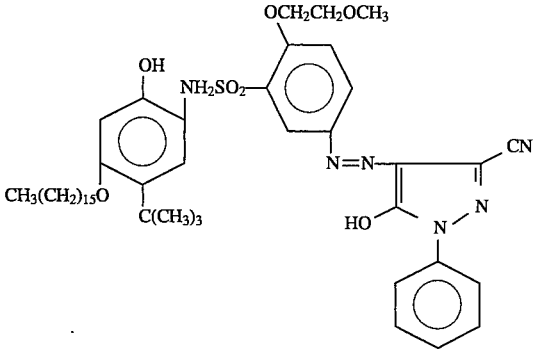

(9) A blue-sensitive emulsion layer containing a blue-sensitive internal latent-image type direct-positive silver bromide emulsion (0.6 g/m$^2$ on a silver basis), 1.1 g/m$^2$ of gelatin, 0.019 mg/m$^2$ of the same nucleating agent as in layer (3) and 0.05 g/m$^2$ of sodium salt of 2-sulfo-5-n-pentadecylhydroquinone.

(10) A layer containing 1.0 g/m$^2$ of gelatin.

| | |
|---|---|
| 1-p-Tolyl-4-hydroxymethyl-4-methyl-3-pyrazolidone | 6.9 g |
| Methylhydroquinone | 0.3 g |
| 5-Methylbenzotriazole | 3.5 g |
| Sodium sulfite (anhydrous) | 0.2 g |
| Sodium salt of carboxymethyl cellulose | 58 g |
| Potassium hydroxide (28% aq. soln.) | 200 ml |
| Benzyl alcohol | 1.5 ml |
| Water | 835 ml |

The light-sensitive element 301 described above was subjected to exposure in the same manner as in Example 1, and then the light-sensitive layer of the exposed light-sensitive element was brought into face-to-face contact with the image-receiving layer of each of the same dye fixing elements 201 to 210 as prepared in Example 1. Further, the foregoing processing composition was spread in a 60 μm-thick layer between both the elements (by means of a pressure-applying roller). The composition-spreading process was carried out at 25° C. After 90-seconds, the light-sensitive element 301 was separated from each dye fixing element, and dried spontaneously.

Light fastness of the thus obtained color images was evaluated in the same way as in Example 1. The results obtained are shown in Table 4.

TABLE 4

Light Fastness of Transferred Dyes on Dye fixing Element

| Dye Fixing Element | Dye Remaining Rate | | |
|---|---|---|---|
| | Cyan | Magenta | Yellow |
| 201 (comparison) | 0.59 | 0.69 | 0.88 |
| 202 (invention) | 0.75 | 0.88 | 0.92 |
| 203 (invention) | 0.79 | 0.84 | 0.93 |
| 204 (invention) | 0.80 | 0.83 | 0.92 |
| 205 (invention) | 0.71 | 0.90 | 0.95 |
| 206 (invention) | 0.73 | 0.87 | 0.95 |
| 207 (invention) | 0.85 | 0.85 | 0.94 |
| 208 (invention) | 0.70 | 0.80 | 0.93 |
| 209 (invention) | 0.75 | 0.89 | 0.93 |
| 210 (invention) | 0.70 | 0.79 | 0.90 |

As can be seen from Table 4, the dye fixing elements comprising the mordants according to the present invention were excellent in light fastness of the dyes transferred thereto as compared with the dye fixing element used for comparison.

As can be seen from the results of the above-described experiments, dye fixing elements containing one or more of the polymer mordants of the present invention exhibit excellent mordanting power and light fastness properties, and consequently, have very excellent image-keeping quality.

While the invention has been described in detail and with reference to specific embodiments thereof, it will be apparent to one skilled in the art that various changes and modifications can be made therein without departing from the spirit and scope thereof.

What is claimed is:

1. A dye fixing element for mordanting a dye, comprising a support and a dye fixing layer comprising a dye fixing polymer mordant, said polymer mordant containing at least one ethylenic monomeric unit represented by formula (I):

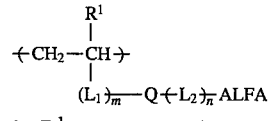

(I)

wherein $R^1$ represents a hydrogen atom or an alkyl group containing 1 to 6 carbon atoms; $L_1$ and $L_2$, which may be the same or different, each represents a divalent linkage group, wherein $L_2$ is selected from the group consisting of an ether linkage, a carbonyl group, an alkylene group, an arylene group, an alkyleneoxy group, an aryleneoxy group and a combination thereof; m and n each represents 0 or 1; Q represents at least one quaternary ammonium group; and ALFA represents at least one group selected from the group consisting of tertiary amines, aromatic 5-membered heterocyclic rings, hydrazides, hydrazones and polyarylphenols.

2. The dye fixing element as in claim 1, wherein said polymer mordant is a homopolymer of said at least one ethylenic monomeric unit.

3. The dye fixing element as in claim 1, wherein said polymer mordant is a copolymer comprising said at least one ethylenic monomeric unit and at least one other monomer copolymerizable therewith.

4. The dye fixing element as in claim 1, wherein said ethylenic monomeric unit contains up to 3 of said ALFA groups, and up to 3 of said at least one quaternary ammonium groups.

5. The dye fixing element as in claim 4, wherein said ethylenic monomeric unit contains one of ALFA group, and one of said quaternary ammonium group.

6. The dye fixing element as in claim 3, wherein said at least one ethylenic monomeric unit comprises at least 10% by weight of the polymer mordant.

7. The dye fixing element as in claim 6, wherein said at least one ethylenic monomeric unit comprises at least 50% by weight of the polymer mordant.

8. The dye fixing element as in claim 3, wherein said other monomer is an ethylenically unsaturated monomer.

9. The dye fixing element as in claim 1, wherein said quaternary ammonium group is a monovalent or polyvalent organic group containing at least one nitrogen atom which bears a positive formal charge and is not bonded directly to any hydrogen atom, and is co-present with a counter anion.

10. The dye fixing element as in claim 1, wherein said polymer mordant is present in an amount of from about 0.1 to 20 $g/m^2$.

11. The dye fixing element as in claim 10, wherein said amount is from 0.5 to 5.0 $g/m^2$.

12. The dye fixing element as in claim 11, wherein said amount is from 1 to 3 $g/m^2$.

* * * * *